United States Patent [19]

Narusch, Jr.

[11] Patent Number: 4,710,410

[45] Date of Patent: Dec. 1, 1987

[54] DUAL BASKET SMALL PARTS COATING APPARATUS

[76] Inventor: Michael J. Narusch, Jr., 5131 Skylite La., Utica, Mich. 48087

[21] Appl. No.: 935,015

[22] Filed: Nov. 26, 1986

[51] Int. Cl.[4] ..... B05D 1/18; B05C 3/00; B05C 19/02

[52] U.S. Cl. ..... 427/430.1; 118/421; 118/423; 118/425

[58] Field of Search ..... 118/52, 421, 423, 425, 118/429; 427/430.1

[56] References Cited

U.S. PATENT DOCUMENTS 2,387,299 10/1945 Ronci ..... 118/52

3,659,550 5/1972 Fulton ..... 118/421 X

*Primary Examiner*—Michael R. Lusignan

*Attorney, Agent, or Firm*—John J. Freer

[57] ABSTRACT

Apparatus is now provided for the contacting of articles with coating liquid such that there is provided increased through put of coated articles. Articles for coating, such as small metallic parts, are placed in a perforate, rotatable, typically wire basket and most often immersed in a tank containing a coating liquid. During this coating operation, an adjacent basket spaced apart from the first basket is discharging coated parts and subsequently taking on fresh parts for coating at a loading/unloading zone. Following this, and the coating of the parts in the first basket, the baskets are moved in a line, e.g., concurrently. The second basket with the fresh parts is moving to its own coating tank for parts coating while the first basket is moving to the zone for unloading coated parts and for loading of fresh uncoated parts. Thus essentially twice the production of coated parts can be produced in an efficient and economical manner. Furthermore the apparatus readily lends itself to ease in color change for coated parts.

12 Claims, 1 Drawing Figure

DUAL BASKET SMALL PARTS COATING APPARATUS

BACKGROUND OF THE INVENTION

Equipment is well known for dip coating of articles, such as small metallic parts, into a liquid while the parts are held in a basket such as a wire basket. The basket loaded with fresh, uncoated parts is immersed in a tank containing the liquid, e.g., a paint. U.S. Pat. No. 2,387,299 shows such an apparatus, which apparatus separates the coated parts from the liquid after coating, and thereafter spins the basket to remove excess liquid coating composition from the parts.

More recently in U.S. Pat. No. 3,659,550 such apparatus has been shown using fluid controlled and actuated valving systems so as to avoid danger of explosion by ignition of the liquid that otherwise might result from an electrical spark.

In such machines, parts can be at least initially dried during the spinning action to remove excess coating liquid. The baskets with the coated parts are then conveyed, such as by hand or machine arm to a receptacle or conveyer. When subsequent heating of coated parts will be necessary for drying of the parts, the basket may be pivoted on an arm which, after the basket has been removed from the liquid and spun, positions the arm over a conveyer. In such position, the parts from the basket are dumped from the basket onto a conveyer leading to an oven for drying or curing of coating composition.

It would be desirable to increase the productivity of such operation while nevertheless maintaining economy of apparatus. Moreover, in large operation, it is quite often necessary to select a variety of colored coating compositions, and apparatus adapted for easy switching to various colors would also be desirable.

SUMMARY OF THE INVENTION

There is now provided an apparatus that can essentially double production over conventional equipment used in association with apparatus feeding parts, e.g., by a system of conveyer belts, through a coating station where the station employs basket immersion and spin drying for coating small parts. Such apparatus is not only efficiently operated but economical in assembly. It moreover offers desirable adaptability including readily lending itself to ease in accommodating color changes.

In its broadest aspect, the present invention is directed to an improvement in coating equipment for applying a fluid coating composition to parts contained in a perforate, rotatable basket, wherein parts for coating are transported to a coating zone containing said basket and coated parts are removed from said basket and said coating zone, and wherein parts contained in said basket are in contact with coating fluid and the basket is rotated to provide intimate contact between parts and coating composition, with there being means for removing parts from said basket for further processing, the improvement in said equipment comprising; first and second coating baskets located in linear relationship to one another in a line extending from a first basket coating zone through a single basket loading/unloading zone to a second basket coating zone; line support elements for said baskets providing support and direction for said baskets moving back and forth from the loading/unloading zone to a coating zone; means for supplying parts to be coated to a basket while said basket is located at said basket loading/unloading zone; means for applying coating composition to parts contained in a basket when said basket is positioned at its coating zone; shuttle means cooperating with said line support elements for shuttling said baskets along said line of relationship from said loading/unloading zone to a coating zone, whereby a first basket is transported by said shuttle means to said loading/unloading zone from its coating zone while said second basket at such time is being shuttled from the loading/unloading zone to its coating zone; and means for removing coated parts from a basket while said basket is positioned at said loading/unloading zone.

In another aspect the present invention is directed to an improved method of applying a coating composition to parts processed in the foregoing coating equipment.

DESCRIPTION OF THE PREFERRED EMBODIMENTS

Figure 1:
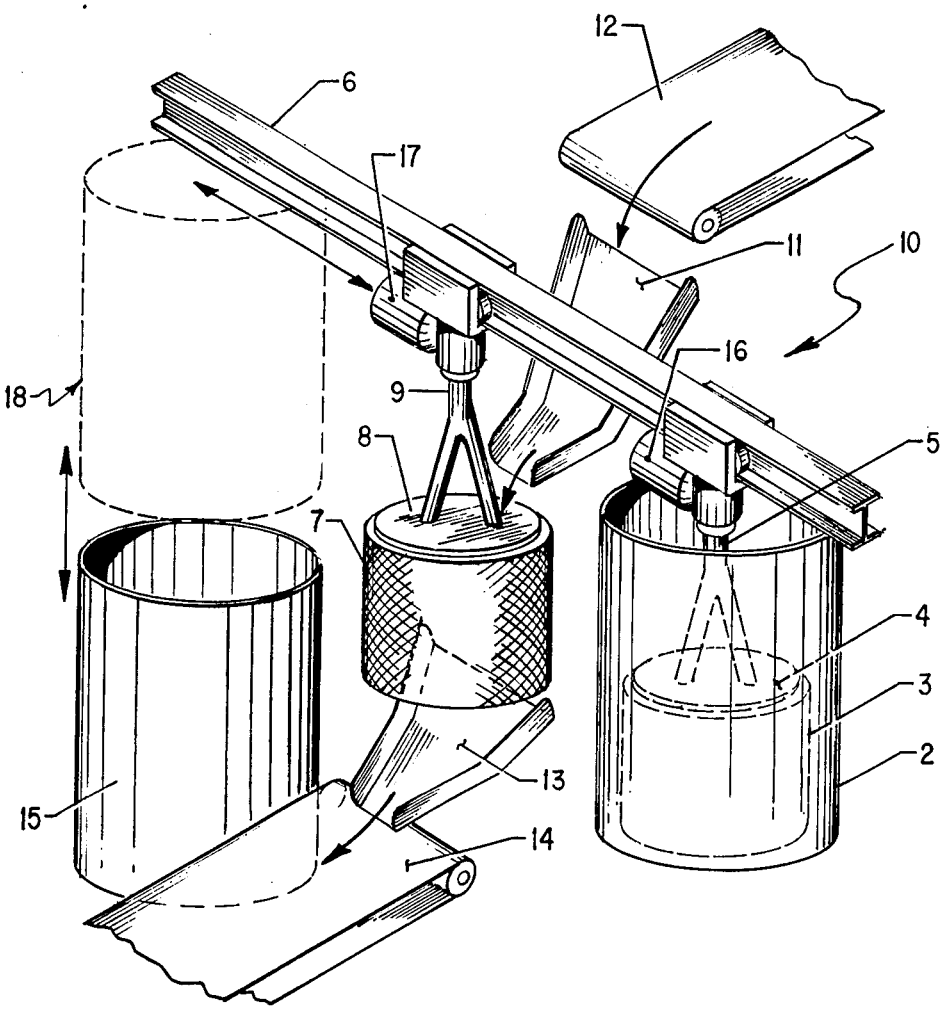
FIG. 1 is a perspective view of a dual basket dip coater apparatus of the present invention.

Small parts for coating are often assembled in a work hopper which empties the parts on to a conveyer. Often, the conveyer will transport the parts to an automatic weighing device. It is typical to have a parts coating station at this zone in the travel of the parts. Upon weighing, the parts for coating can be immersed in a coating composition, using a perforate basket to contain the parts, the parts and coating liquid are separated, and then typically the resulting freshly coated parts are conveyed to a drying or curing zone.

As such is carried out in accordance with the present invention, and referring more particularly to the drawing, FIG. 1 depicts apparatus of the present invention having a first coating tank (2). This tank (2) contains a coating liquid, not shown. At the lower part of the tank (2) is a perforate, typically wire mesh, first basket (3). This first basket (3) can have a cover (4), which is optional, and be equipped with an attendant basket support (5), that supports the first basket (3) and cover (4) from a guide rail (6). The support (5) is engaged by a motor (16) useful for spinning the basket (3). The first basket (3) positioned in the first coating tank (2) is in the coating position.

Spaced apart from the first basket (3) along the guide rail (6) is a second basket (7). As with the first basket (3), the second basket (7) may also have a cover (8), a support (9) and a motor (17). The support (9) for the second basket (7) is likewise connected with the guide rail (6), as for the first basket (3). The second basket (7) is positioned at a basket loading/unloading zone shown generally at (10). This zone (10) is equipped with a basket feed hopper (11), shown overhead of the second basket (7) and above this basket feed hopper (11) is a fresh parts feed conveyer (12). Located in the zone (10) under the second basket (7) is a coated parts discharge hopper (13) which is located above a coated parts discharge conveyer (14).

Also located along the guide rail (6), and spaced apart from the basket loading/unloading zone (10) in a direction removed from the first coating tank (2) is a second coating tank (15). As with the first coating tank (2), the second coating tank (15) can be raised and lowered and is shown at (18), in phantom, in the raised position.

In operation, parts for coating are present in the first basket (3) when the first basket (3) reaches the first coating tank (2). While this basket (3) is in the coating position, the second basket (7) is located at the basket loading/unloading zone (10). Referring then to the first basket in this phase of the operation, this first basket (3) is immersed into coating liquid, not shown, contained in the first coating tank (2). As the basket (3) is positioned over the tank (2), the tank (2) is raised to immerse the basket (3) into the coating composition within the tank (2). This is typically referred to as dip coating. By means of the first basket motor (16), the first basket (3) is spun in the coating tank (2) to provide liquid coating upon the parts contained in the basket (3).

During this coating operation for the first basket (3), the second basket (7) is at that time positioned at the basket loading/unloading zone (10). Coated parts from the second basket (7) are first unloaded, this being a bottom unloading by means not shown. The parts therefore fall from the second basket (7) onto the coated parts discharge hopper (13) and are thereafter gravity fed onto the coated parts discharge conveyer (14). The parts may then be conveyed to a drying oven or the like, not shown. Subsequent to closing of the bottom of the second basket (7) following parts discharge, fresh parts for coating are fed from a source not shown, such as adjacent automatic weighing equipment, by means of the fresh parts feed conveyer (12) to the basket loading-/unloading zone (10). Upon reaching the end of the conveyer (12) the parts for coating are gravity fed through the basket feed hopper (11) into the second basket (7), the second basket cover (8), if present, being removed during the basket loading.

Typically during this loading operation of the second basket (7), the first basket (3) is being separated from the coating liquid in the first coating tank (2) as by lowering of the tank (2), such that the first basket (3) is in the upper zone of such coating tank (2). Therein, the first basket (3) is spun to dry the coated parts. This is typically referred to as spin drying. Upon completion of spinning of the first basket (3), and the further lowering of the first coating tank (2) to completely separate basket (3) and tank (2), plus completion of the loading of the second basket (7), the dual baskets (3), (7) are then shuttled along the guide rail (6). In this shuttle operation, conducted by means not shown, the second basket (7) proceeds from the basket loading/unloading zone (10) to a position over the second coating tank (15), which is in lowered position. In this position, the parts in the second basket (7) proceed through the immersion coating and spin drying operation. During this procedure, the first basket (3) moves along the guide rail (6) from the first coating tank (2) to the basket loading/unloading zone (10). At this time the first basket (3) in the basket loading/unloading zone (10) feeds coated parts through the coated parts discharge hopper (13) to the coated parts discharge conveyer (14). Thereafter, typically during spin drying of the freshly coated parts in the second basket (7), fresh parts are fed from the basket feed hopper (11) into the first basket (3).

Although certain elements of the invention apparatus have been shown by specific embodiments, it will be obvious to those skilled in the art that various substituted and equivalent equipment may be useful. Thus, the basket feed hopper (11) and the coated parts discharge hopper (13) can either or both be replaced by vibratory chutes or simply conveyers. Moreover, such feed hopper (11) and fresh parts feed conveyer (12) can be in combination replaced by a vibratory chute such as leading from a work hopper. Moreover, parts can be emptied from a first or second basket (3), (7) in the basket loading/unloading zone (10) directly onto a discharge conveyer (14) or into bulk storage equipment. For such dumping, hinged bottoms on the buckets (3), (7) cooperating with two latches, or other such apparatus, can be useful.

It is conventional that the covers (4), (8) for the baskets (3), (7) can be slidably removable, such as along rails, from the baskets (3), (7) for feeding parts thereto. Such features as have found utility in the prior art are contemplated for use with the baskets of the present invention. So long as the baskets are perforate, usually wire mesh, such will be suitable in the present invention. Any such basket that is useful in apparatus of this type is contemplated. Moreover, bottom discharge baskets are conventional and well-known in the art. Although the invention has been depicted using a guide rail (6) as the line support element providing support and direction for the baskets (3), (7) moving back and forth, it will be understood that any means for such support and direction, e.g., a chain-link conveyer or the like which can serve as shuttle means for the baskets (3), (7) is contemplated. Moreover, the basket supports (5), (9) can be essentially rigidly linked along the line support elements to provide virtually the completely simultaneous movement of the baskets (3), (7) in their travel. Or the supports may be more loosely linked such that travel need not be simultaneous. Although an automatic movement system is preferred, it is understood that manual shuttling of baskets (3), (7) may occasionally or more often be useful or necessary. It is therefore not necessary that the baskets (3), (7) move precisely simultaneously, although it is preferable that tandem movement during apparatus operation be performed.

As has been hereinbefore described, it will be useful to employ coating tanks (2), (15) which can be elevated and lowered. In this manner the tanks (2), (15) can bring coating liquid into contact with the parts in the baskets (3), (7) and thereafter provide for ready separation of parts and coating liquid. However, other such means for bringing parts and liquid together, e.g., lowering of the baskets (3), (7) into the tanks (2), (15), are contemplated. The tanks (2), (15) are at least approximately twice as tall as the height of the baskets (3), (7) to permit space above the coating liquid within the tanks (2), (15) in which to spin dry the baskets (3), (7), while maintaining coating liquid thereby removed in the tanks (2), (15). It is, however, contemplated that even deeper or shallower tanks can be employed so long as the baskets (3), (7) can be above liquid level and within the tanks (2), (15), or related housing, on spinning.

As will be apparent to those skilled in the art, the equipment of the present invention, between the fresh parts feed conveyer (12) and the coated parts discharge conveyer (14) can essentially double production over conventional equipment. Moreover, the apparatus readily lends itself to ease in basket change and also color change. Moreover, the coating tanks (2), (15) need not provide the same coating color during operation. Thereby parts in basket batches can be readily alternated between two colors. Although automatic loading and unloading of the baskets has been shown, it will be understood by those skilled in the art that manual operation can likewise be useful. Moreover, baskets which are emptied other than by bottom emptying can be used. It will therefore be understood by those skilled in the art that a preferred embodiment of the invention has been illustrated such as with direction of movement and gravity assisted loading and unloading. However, although the guide rail or the like will generally be at an angle to the path of travel of the parts, and for the preferred embodiment is positioned transverse to such path of travel, other arrangements may be serviceable. Moreover, gravity feed and unloading of parts is economical and preferred. However, other modes of applying principles of the invention may be employed.

What is claimed is:

1. An improvement in coating equipment for applying a fluid coating composition to parts contained in a perforate, rotatable basket, wherein parts for coating are transported to a coating zone containing said basket and coated parts are removed from said basket and said coating zone, and wherein parts contained in said basket are in contact with coating fluid and the basket is rotated to provide intimate contact between parts and coating composition, with there being means for removing parts from said basket for further processing, the improvement in said equipment comprising;

first and second coating baskets located in linear relationship to one another in a line extending from a first basket coating zone through a single basket loading/unloading zone to a second basket coating zone;

line support elements for said baskets providing support and direction for said baskets moving back and forth from the loading/unloading zone to a coating zone;

means for supplying parts to be coated to a basket while said basket is located at said basket loading-/unloading zone;

means for applying coating composition to parts contained in a basket when said basket is positioned at its coating zone;

shuttle means cooperating with said line support elements for shuttling said baskets along said line of relationship from said loading/unloading zone to a coating zone, whereby a first basket is transported by said shuttle means to said loading/unloading zone from its coating zone while said second basket at such time is being shuttled from the loading/unloading zone to its coating zone; and means for removing coated parts from a basket while said basket is positioned at said loading/unloading zone.

2. The improvement of claim 1 wherein the direction of supplying parts to a basket is in line with the direction of unloading coated parts from a basket thereby providing a general line of travel for said parts, and the linear relationship of said coating baskets is positioned at an angle transverse to said line of travel for said parts.

3. The improvement of claim 1, wherein said coating baskets are wire mesh baskets and said line support elements comprise a guide rail.

4. The improvement of claim 1, wherein said parts supplying means comprise a conveyer.

5. The improvement of claim 1, wherein said means for applying coating composition includes a tank containing coating liquid.

6. The improvement of claim 1, wherein said shuttle means comprises a chain connecting support means of each basket along said line support elements.

7. The improvement of claim 1, wherein said means for removing parts from a basket includes conveyer means.

8. The improvement in the method of applying a fluid coating composition to parts processed in coating equipment which includes a perforate, rotatable basket, where parts are loaded to a basket, the basket is contacted with coating composition and rotated therein to provide intimate contact between parts and coating composition, and coated parts are discharged from said basket, the improvement comprising;

establishing a path of travel for said parts, which path includes a direction of movement for uncoated parts to be charged to a basket, as well as a direction of movement for coated parts discharging from a basket;

providing a basket loading/unloading zone in said path of travel;

establishing a line of travel for a first and second basket, which line intersects said parts path of travel at said loading/unloading zone and extends there through from a first basket coating zone to a second basket coating zone;

supplying parts to be coated to a first basket at said loading/unloading zone while said second basket is located at its coating zone;

shuttling the resulting loaded first basket from said loading/unloading zone along the basket line of travel to the first basket coating zone; while at the same time shuttling the second basket along the basket path of travel from its coating zone to the basket loading-/unloading zone; and unloading said second basket at the loading/unloading zone, while subsequently loading same, and while at that time coating parts in said first basket located at its coating zone.

9. The method of claim 8, wherein said line of travel for said first and second basket is established in a line transverse to said path of travel of said parts.

10. The method of claim 8, wherein parts for coating in said baskets are coated by contacting the parts therein with coating composition retained in a tank.

11. The method of claim 10, wherein parts in contact with coating composition are rotated in said baskets during said contact.

12. The method of claim 10, wherein coated parts in said basket are separated from said coating composition and said basket is rotated for removing excess composition from said parts.

* * * * *